US006042365A

United States Patent [19]

Chen

[11] Patent Number: 6,042,365

[45] Date of Patent: Mar. 28, 2000

[54] FUEL COMBUSTION MONITORING APPARATUS AND METHOD

[76] Inventor: Yaosheng Chen, 911 Allendale Ct., Blacksburg, Va. 24060

[21] Appl. No.: 09/342,166

[22] Filed: Jun. 28, 1999

[51] Int. Cl.[7] ..... F23N 5/08; F23N 5/18; F23N 5/00

[52] U.S. Cl. ..... 431/12; 431/13; 431/14; 431/79; 431/89; 431/90

[58] Field of Search ..... 431/14, 12, 89, 431/79, 75, 13, 90; 340/578

[56] References Cited

U.S. PATENT DOCUMENTS

| | | | |
|---|---|---|---|
| 3,716,717 | 2/1973 | Scheidweiler et al. | 431/79 |
| 4,039,844 | 8/1977 | MacDonald | 431/79 |
| 4,370,557 | 1/1983 | Axmark et al. | 431/79 |
| 4,830,601 | 5/1989 | Dahlander et al. | 431/79 |
| 4,913,647 | 4/1990 | Bonne et al. | 431/12 |
| 5,829,962 | 11/1998 | Drasek et al. | 431/79 |

*Primary Examiner*—Carl D. Price

[57] ABSTRACT

A method and an apparatus for monitoring fuel combustion status in a burner such as a boiler and a gasifier with high accuracy, high reliability and fast response are disclosed. The apparatus comprises a series of fiber optic flame monitors that are installed next to each nozzle inside said burner to determine temperature, flame flash frequency and the burned fuel particle density. In terms of a master controller and a group of on-line controllers, the optimized combustion of the burner is approached by monitoring the combustion status of each nozzle and regulating the discharges of air or oxygen and fuel to each nozzle, in accordance with the comparison of the data detected by flame monitors and optimal data.

8 Claims, 2 Drawing Sheets

FUEL COMBUSTION MONITORING APPARATUS AND METHOD

FIELD OF INVENTION

The present invention relates to a fuel combustion control apparatus and method in general, and more particularly to a method and apparatus for the on-line fuel combustion status monitoring of boilers or burners used in power plants and other industries.

BACKGROUND

A large boiler or burner comprises a plurality of nozzles used to inject a reactive mixture of hydrocarbon fuel (i.e. coal or oil or gas) and air or oxygen into a combustion chamber where heat or syngas is produced. Heretofore, three methods have been available for monitoring the combustion status of large boilers. In one method known in the art, the volume of air and the volume of coal supplied to the combustion chamber are controlled in accordance with the temperatures inside the furnace, as disclosed in U.S. Pat. No. 5,049,063 entitled "Combustion control apparatus for burner." Since the boiler is equipped with as many as 36 or more nozzles, it is impossible to determine the combustion status of the entire system and to discriminate the abnormal combustion status caused by a single nozzle or by a group of nozzles based on a localized temperature measurement inside the furnace. In another method known in the art, each nozzle is equipped with a flame detector. However, a flame detector only has a function to discriminate "fire on or off," and does not possess the function of combustion status monitoring, this method often causes an excess amount of fuel to accumulate, even to a point where there is the danger of having an uncontrolled explosion within the combustion chamber. In still another method known in the art, a combustion status monitoring system may be used comprising a CCD scan camera, a monitor and an automatic control unit. The CCD camera is used to scan the flame color of each nozzle, and the combustion status is observed by the monitor to thereby optimize the volume of supplied air and fuel. Since the CCD camera cannot be installed inside the combustion chamber due to the high temperature, the small view field of the CCD camera makes it impossible to scan the entire relevant target area inside the large chamber. On the other hand, the camera cannot distinguish the flame locations, therefore, the similar signature of the background and nearby flames often cause such systems to produce unacceptable errors and incorrect results.

It is an objective of the present invention to provide a novel combustion status monitoring system and method based on not only the measurements of temperature, but also on the flame flash frequencies and the burned fuel particle densities inside the entire combustion chamber. It is another objective of this invention to provide a relatively simple, low cost, yet highly effective and accurate combustion status monitoring system capable of monitoring the combustion status of the entire boiler by monitoring the combustion status of each nozzle.

Figure 1:
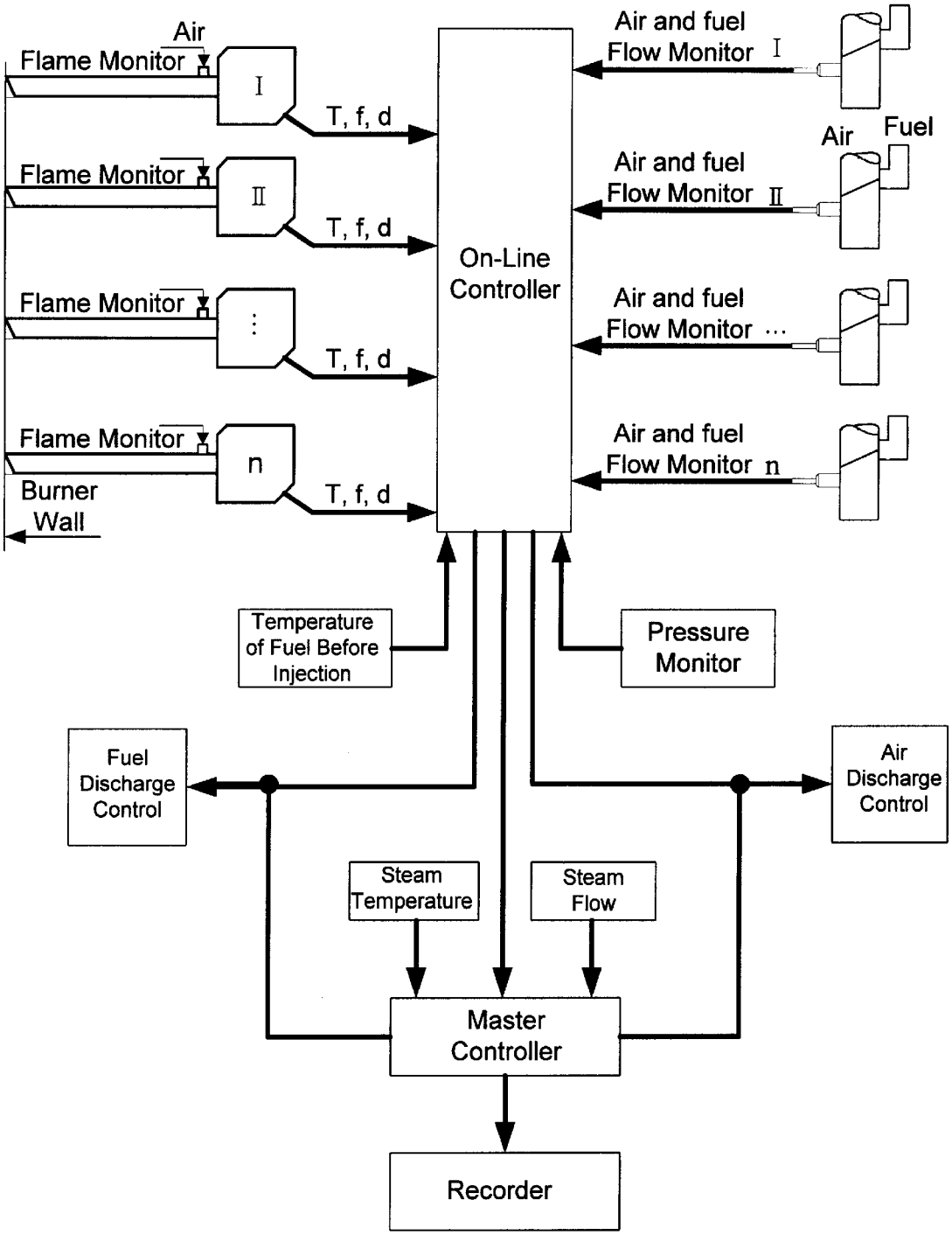
FIG. 1 shows a schematic block diagram of the on-line combustion status monitoring apparatus. In one embodiment, if the height of the boiler is about 8 stories high, four flame monitors used in each story are connected to one on-line controller, and 32 flame monitors employed for the entire boiler are connected to 8 on-line controllers. All the on-line controllers are terminated in a master controller.

| REFERENCE NUMERALS IN DRAWINGS |
|---|
| 1. Sight glass |
| 2. Optical lens |
| 3. Spatial filter |
| 4. Flame monitor housing |
| 5. Objective lens |
| 6. Optical fiber cable |
| 7. Optical path splitter |
| 8. Amplifier |
| 9. Optical filter |
| 10. On-line controller |
| 11. Master controller |
| 12. Air and fuel flow monitor |
| 13. Air discharge |
| 14. Fuel discharge |
| 15. Housing of purge air unit |
| 16. Purge air inlet |

DETAILED DESCRIPTION

The present invention provides a method and an apparatus for the on-line fuel combustion status monitoring of large boilers and burners with fast response, high accuracy and reliability. The apparatus can be modified to include certain features, depending upon the characteristics of the fuel combustion. The apparatus can be economical to provide and operate, and can have an accuracy sufficient to meet existing and changing requirements in applications such as on-line fuel combustion monitoring in the energy industry and other related industries.

Referring to FIG. 1, every nozzle is equipped with a flame monitor, and each four flame monitors on the same story share an on-line controller unit, or all the flame monitors along a vertical direction share an on-line controller unit. All the on-line controllers are terminated in a master controller. Other information collected by prior art instrumentation such as the temperature of fuel before injecting into the burner, the pressure inside the chamber, steam temperature and flow output in the pipes outside the chamber, and fuel and air discharge, are also input into the master controller. The optical signals including temperature T, flame flash frequency f, and the burned fuel particle density d, collected by each flame monitor, are transmitted to the on-line controllers. Based upon all the data collected including air (or oxygen) and fuel discharges and air (or oxygen) to fuel ratio in each fuel discharge pipe, steam temperature and volume produced in the output pipes, pressure inside the chamber, and the temperature of fuel before injection to the combustion chamber, the master controller regulates the discharges of air (or oxygen) and fuel to achieve the optimized combustion status.

Figure 2:
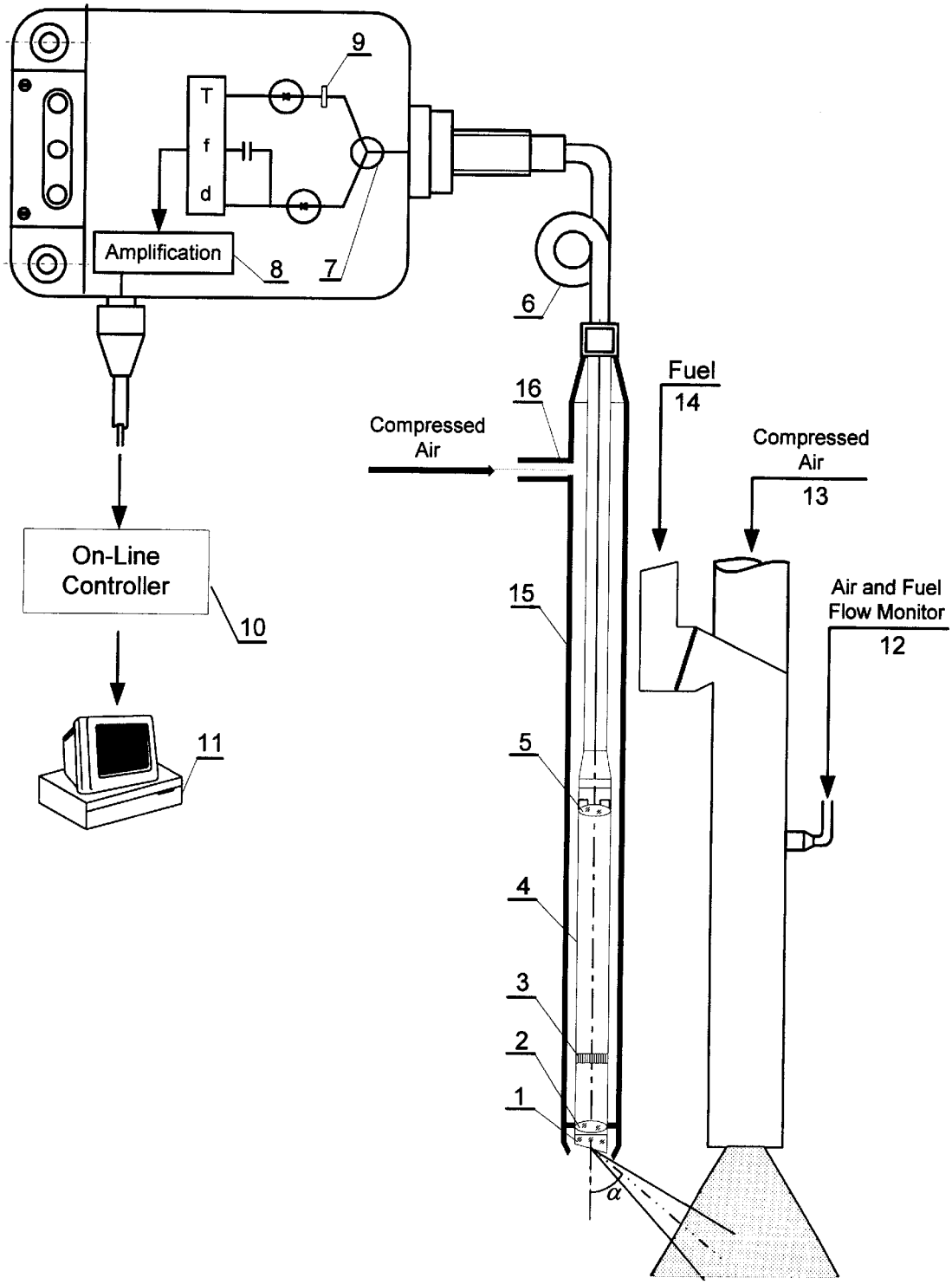
FIG. 2 is a graphical representation of a flame monitor.

Referring to FIG. 2, a flame monitor includes a flame monitoring housing 4 which may be any high temperature metal, such as stainless steel. At the end of said housing 4 nearest combustion chamber, is a sight glass 1, which may be quartz or other single crystals. Two types of sight glasses, direct-view or inclined-view, may be used. For the direct-view glass, the view axis is coincident with the central axis of the housing 4. An inclined-view glass has an inclined view axis $\alpha$ corresponding to the central axis of the housing 4, as shown in FIG. 2. Due to space limitations inside the combustion chamber, the flame monitor in general cannot point directly into the flame area of a nozzle, therefore, the flame monitor with an inclined-view glass lens is adopted. An optical lens 2, a spatial filter 3, an objective lens 5 and a piece of optical fiber cable 6 are assembled inside housing 4 in turn. The said spatial filter 3 is used to delete the interference of the background flame and the nearby random flame. The second function of the spatial filter 3 is to provide an optical system with a large-view and long-focus point. The spatial filter 3 may be either an optical fiber plate or a crossed grating, the blocking part of said crossed grating and said bundle of ordered optical fibers may be fabricated by either black painting or polishing. The flame signals from the combustion chamber are conveyed through sight glass I and optical lens 2 in turn, then focused in the plane of the spatial filter 3. After the interference signals from the background and nearby fields are removed by the spatial filter 3, the flame signals are focused on one end of a piece of optical fiber 6 by said objective lens 5. The signals are then transmitted to an optical path splitter 7 though said piece of optical fiber cable 6. The light coming from said optical path splitter 7 is divided into two parts. One part goes through an infrared optical filter 9 and focus on a photoelectric converter. The output electrical signals provide the temperature changes, ranging from 500 to 1650° C. Another part of the light passes through another photoelectric converter, and the output is further divided into two signals: an AC signal and a DC signal. When the fuel discharged from a nozzle is ignited, it will explode and emit a flash, the flame flash frequency, ranging from 4 to 150 Hz, is related to the AC frequency signal. On the other hand, the burned fuel density distribution d can be determined by the brightness, since the more fuel particles that are ignited, the higher the brightness peak. Therefore, the DC signal component provides the information concerning the burned fuel particle density d. The three signals, temperature T, flash frequency f, and the burned fuel particle density d, are further amplified by an amplifier 8 and transmitted to the on-line controller 10.

The on-line controller performs data processing and automatic control functions. The following is a description of the operation of the burner combustion monitor system described above.

The radiant heat energy, $W=\epsilon T^4$($\epsilon$=Boltzman constant), can be obtained from the temperature measured, and the quantity of heat in the solid angle detected by a flame monitor can be represented by $Q=mc\Delta T$ (c is the specific heat, and m represents the burned fuel weight). The quantity of air and fuel discharged can be monitored by an air discharge gauge and a fuel discharge gauge, respectively. The radiant thermal energy W and quantity of heat Q should be equal when an optimization of combustion status is achieved.

Since the combustion efficiency relates to the quality of the fuel used, the temperature of air (or oxygen) and fuel prior to admission into the furnace, humidity and the ratio of air (or oxygen) to fuel (coal or oil or gas), and the three series of previously fixed optimal values of T, f and d have been installed in the master controller. When the signals of T, f and d from the flame detectors arc input into the master controller, the master controller compares the values represented by the signals with the three series of T, f and d ranges previously set therein. If the inputs deviate from the normal values, the master controller transmits a signal to the combustion air and fuel discharge control systems to adjust the air and fuel feed. For example, a) when all three parameters of flash frequency f, temperature T, and the burned fuel particle density d appear low, it indicates the extinction of fuel combustion, b) when flash frequency f and temperature T display normal, but the burned fuel particle density d appears low, it may indicate either a low fuel combustion efficiency (i.e. air feed is not enough or too much fuel has been discharged) or an overload. The master monitor will send an order to decrease the fuel feed to have the fuel fired more completely. If d increases, it means that the previous fuel discharge was overloaded. If d continues to decrease, it indicates the discharge of fuel is not enough and the fuel flow will be increased based on the comparison of temperature T and flash frequency f to obtain the optimized discharges of air and fuel, as well as the air to fuel ratio. A distinguishing feature of the present invention is that discharges and the combustion status of each nozzle can be monitored by its corresponding on-line controller, thus the combustion optimization of the entire burner is realized by the combustion optimization of each nozzle. Tests using the sample apparatus in a power plant demonstrate the following results.

Temperature measurement range: 500–3500° C.

Temperature measurement accuracy: <0.5° C.

Flash frequency measurement range: 4–150 Hz

The burned coal particle density accuracy: 0.1% full scale

Response time: <1 ms

Inclined-view flame detectors may be replaced by direct-view flame detectors, which are installed at an angle of less or equal to 90° with the nozzles.

With further regard, the flame monitor also includes purge air means, denoted generally by the reference numerals 15 and 16 in FIG. 2. The purge air means is designed to provide a means for the purpose of purging particles, to thus ensure the flame monitor remains unobscured and also serves as a cooling means. The purge air means includes a purge air housing 15 and an air inlet 16. The purge air can be compressed air, or oxygen, or some other gas.

For a relatively small burner, only one or several direct-view flame detectors may be used to detect the flame parameters of the burner with lower accuracy.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A method for the on-line combustion status monitoring of a burner using an apparatus consisting of a plurality of fiber optic sensor-based flame monitors, comprising the steps of:

receiving and transporting optical radiation emitted by a frame inside a burner to collect;

deleting the interference of the background flame and the nearby random flame by using a spatial filter;

transforming said received and filtered optical radiation associated with flame spectra into electrical signals;

determining temperature T, flame flash frequency f, and the burned fuel particle density d inside said burner near each nozzle from said electrical signals by said plurality of fiber optic flame monitors;

amplifying and transmitting the signals associated with temperature T, flame flash frequency f, and the burned fuel particle density d into a master controller through a group of on-line controllers;

comparing all three signals of temperature T, flame flash frequency f, and the burned fuel particle density d obtained with the desired fixed values of these parameters previously set;

adjusting the ratio of the air or oxygen supply to the fuel injected into said burner, based on the deviation of T, f, and d values from the desired values of these parameters;

controlling the operation of the burner to the nearest possible optimization condition by monitoring the combustion status of each nozzle and, through such feedback control, regulating the discharges of air or oxygen and fuel to each nozzle.

2. The method of claim 1 wherein said apparatus comprising:

a plurality of fiber optic flame monitors for receiving and optically transporting the optical signal provided by flame radiation, for deleting the interference of the background flame and the nearby random flame, for transforming the optical spectrum of the flame radiation signals into electrical signals, for determining and amplifying said electrical signals which represent temperature T, flame flash frequency f, and burned fine fuel density d near each nozzle, each nozzle equipped with one fiber optic flame monitor;

an on-line controller for integrating and monitoring a group of fiber optic flame monitors;

a master controller for integrating and monitoring all the fiber optic flame monitors through a group of on-line controllers, said master controller providing means for controlling the discharge ratio of air-to-fuel in accordance with the comparison of the data of temperature T, flame flash frequency f and burned fine fuel density d detected by flame monitors and the desired operating values of these parameters;

air or oxygen and fuel flow control means for controlling the supply of air or oxygen and fuel supply to each nozzle of said burner by the master controller on the basis of said comparison data.

3. The apparatus as claimed in claim 2, wherein said flame monitor, having an inclined-view optical window and being installed parallel to a nozzle of said burner, comprising:

receiving and transporting means for viewing and transporting an optical signal associated with flame radiation, said receiving and transporting means including an optical lens, spatial filter, objective lens, a single optical fiber cable and an optical path splitter, said spatial filter providing a means for deleting the interference of the background flame and the nearby random flame, said optical path splitter providing a means for splitting light from the optical fiber cable into first and second light paths;

means for transforming the light from said first light path and a piece of optical filter into an electrical signal that represents temperature T;

means for transforming the light from said second light path and a piece of optical filter into an electrical signal with its alternating current component representing the flame flash frequency f and its direct current component standing for the burned fuel particle density d;

means for amplifying said three signals T, f, and d and inputting them into an on-line controller and then a master controller;

said master controller for sending signals to said on-line controllers to adjust the discharges of air or oxygen to fuel of the responding nozzle based on the deviation of T, f, and d values from the normal values which are stored;

purge air means including a purge air or oxygen inlet pipe secured on said tube of the flame monitor so as to provide an inlet passage into said tube for supplying purge air or oxygen in surrounding relation to said flame monitor for the purpose of purging particulate matter so as to ensure that said flame monitor remains unobscured and also serves as a cooling means.

4. Apparatus as claimed in claim 3 wherein said spatial filter is a crossed grating.

5. Apparatus as claimed in claim 3 wherein said spatial filter is an optical fiber plate that is made using a bundle of ordered optical fibers, the opaque part of said bundle of ordered optical fibers may be fabricated either by painting with black paint or by polishing.

6. The apparatus as claimed in claim 2, wherein said flame monitor, having a direct-view window and being installed parallel to a nozzle of said burner, comprising:

receiving and transporting means for viewing and transporting an optical signal associated with flame radiation, said receiving and transporting means including an optical lens, spatial filter, objective lens, a single optical fiber cable and an optical path splitter, said spatial filter providing a means for deleting the interference of the background flame and the nearby random flame, said optical path splitter providing a means for splitting light from the optical fiber cable into first and second light paths;

means for transforming the light from said first light path and a piece of optical filter into an electrical signal that represents temperature T;

means for transforming the light from said second light path and a piece of optical filter into an electrical signal with its alternating current component representing the flame flash frequency f and its direct current component standing for the burned fuel particle density d;

means for amplifying said three signals T, f, and d and inputting them into an on-line controller and then a master controller;

said master controller for sending signals to said on-line controllers to adjust the discharges of air or oxygen to fuel of the responding nozzle based on the deviation of T, f, and d values from the normal values which are stored;

purge air means including a purge air or oxygen inlet pipe secured on said tube of the flame monitor so as to provide an inlet passage into said tube for supplying purge air or oxygen in surrounding relation to said flame monitor for the purpose of purging particulate matter so as to ensure that said flame monitor remains unobscured and also serves as a cooling means.

7. Apparatus as claimed in claim 6 wherein said spatial filter is a crossed grating.

8. Apparatus as claimed in claim 6 wherein said spatial filter is an optical fiber plate that is made using a bundle of ordered optical fibers, the opaque part of said bundle of ordered optical fibers may be fabricated either by painting with black paint or by polishing.

* * * * *